United States Patent [19]

Schäffeler et al.

[11] 4,286,125

[45] Aug. 25, 1981

[54] ELECTRIC SWITCH WITH TWO SWITCHING PARTS ACTING AT DIFFERENT TIMES

[75] Inventors: Alois Schäffeler; Uwe Stratmann, both of Spaichingen, Fed. Rep. of Germany

[73] Assignee: J & J Marquardt, Fed. Rep. of Germany

[21] Appl. No.: 72,829

[22] Filed: Sep. 6, 1979

[30] Foreign Application Priority Data

Sep. 7, 1978 [DE] Fed. Rep. of Germany ..... 2838934

[51] Int. Cl.[3] ..... H01H 19/00

[52] U.S. Cl. ..... 200/6 B; 200/153 LA; 200/157; 310/48

[58] Field of Search ..... 200/157, 6 R, 6 A, 6 B, 200/6 BA, 6 BB, 6 C, 153 R, 153 L, 153 LA, 153 LB, 68; 310/48

[56] References Cited

U.S. PATENT DOCUMENTS

| | | | |
|---|---|---|---|
| 731,375 | 6/1903 | Liggett | 200/153 LA |
| 843,902 | 2/1907 | Lewis | 200/153 L |
| 3,328,613 | 6/1967 | Gawron | 310/48 |
| 4,061,895 | 12/1977 | Hultz | 200/157 |
| 4,095,072 | 6/1978 | Piber | 200/1 V |

*Primary Examiner*—J. V. Truhe
*Assistant Examiner*—Morris Ginsburg
*Attorney, Agent, or Firm*—McGlew and Tuttle

[57] ABSTRACT

An electric switch comprises a switch housing having a contact arm pivotally mounted on a conductive bearing. The contact arm includes a movable contact which is disposed in the housing to engage with a fixed contact of the housing in one position of the contact arm. It also includes a hook shaped end which engages on a cam surface of a slider portion of an actuating member. The contact arm is loaded by a tension spring which is mounted in the housing so that it is urged in a direction to engage the moving contact thereon with the fixed contact in the housing when the slider, which is moved by the actuating member is moved so as to permit the contact arm to pivot. The switch housing advantageously includes a second housing portion with a second switching mechanism similar to the first but which is moved during the movement of the actuating member under the control of a cam slider portion of the actuating member and that it moves faster and causes engagement of its movable contact with a fixed contact in the housing faster than the other contact arm. The actuating member itself is advantageously provided with an electrical switch member which rides over a resistance so as to cut in and out a resistance to control, for example, the speed of operation of an electric motor which is first switched on by engagement of a movable contact with a fixed contact.

8 Claims, 4 Drawing Figures

ELECTRIC SWITCH WITH TWO SWITCHING PARTS ACTING AT DIFFERENT TIMES

FIELD AND BACKGROUND OF THE INVENTION

This invention relates in general to the construction of switches and in particular to a new and useful switch particularly for the control of small electric motors such as electrical tools, hand drills, etc. which includes a contact arm which is pivotally mounted in a housing and which may rotate into a contact making position in the control of a slider cam of an actuating member.

The inventive type switches are frequently employed in hand-operated electric tools, particularly hand drills, thus in series-manufactured implements requiring a high number of switching operations, but, on the other hand, low manufacturing costs. Switches of this kind are known per se. The drawback of the known types is however, that they comprise a relatively high number of component parts which makes them not only expensive but also suceptible to troubles, and that the contact pressure on the switch parts may vary.

SUMMARY OF THE INVENTION

The invention is directed to a switch which is particularly simple in design and produces a definite and high contact pressure.

In accordance with the invention an electric switch is provided which comprises a switch housing having a contact arm mounted in the housing on electrically conductive bearing means so that it may be pivoted to engage one movable contact arm portion with a fixed contact when an opposite lever arm portion of the contact arm is guided on a cam upon movement of an actuating member. The actuating member cam moves to permit the second arm to rotate under the force of a loading spring connected to the first arm portion.

During the displacement of the actuating member, the contact arm portion engaging the cam slides along a slanting cam side, whereby the contact arm performs a pivotal motion under the action of the loading spring. The force of the spring must be so dimensioned that in the end position of the pivotal motion, i.e. with the movable contact butting against the opposite contact, still a sufficient spring force is present to effect a satisfactory contact pressure. The faster the contact arm is pivoted the faster and steeper the side portion of the cam is. It is easily possible to obtain a switching operation of the switch similar to that of a snap-action switch. In the final switching position, a contact between the contact arm and the cam is no longer needed and, preferably, not provided. This switch makes it also easily possible to provide an over-travel. The switch, of course, may be designed as a two-position switch, or as a switch with a normally-closed contact, but the preferable design is a switch with a normally-opened contact. By "cam tip", the top of the cam elevation is understood, which may also be shaped as a flat area.

In a preferred embodiment of the invention, the loading spring is designed as a tension spring acting on the lever arm carrying the contact. The other end of the tension spring which, preferably, is designed as a helical tension spring, may be suspended from a bolt or the like which, preferably, is formed on the casing. A further development of the invention provides that the support is electrically conducting and connected to a terminal. The cam, on the contrary, is made of an electrically non-conducting material and, preferably, integral with the actuating member.

The switch housing of the invention advantageously includes at least two separate switching chambers each of which includes a contact arm which is pivotally mounted in a respective chamber and each of which is rotated into a contact making position by advancement of an actuating member and wherein a cam control is such that one switch is operated upon a smaller displacement of the actuating member than the other.

The actuating member has two parts, each extending toward one switching chamber and including a cam. The different switching instants can simply be obtained by a dissimilar arrangement and/or design of the switching cams. With an equal shape of the cams, the slanting sides along which the contact arm slides during the switching operation, must be offset in the displacement-direction of the actuating member. However, if the slants of the cam sides start from approximately the same cross section of the actuating member, the side of the cam of the first switching mechanism must be relatively steep-sloped and that of the second switching mechanism must be flat-sloped, according to another embodiment of the invention providing that the actuating member includes slider elements which are operable in two separate switch contact arm chambers and the cams are shaped differently so that the switches are actuated at different actuating times. The actuating member is advantageously designed as a push button which includes a slider portion thereof carrying the cams and it is preferably provided with a resistor surface of an electronic control which is actuated by advancement of the actuating member.

The electronic control may be accommodated in a third switching chamber of the switch housing. Such a control is employed particularly in switches for hand drills and it comprises, in a manner known per se, a controllable rectifier and a device for controlling the phase angle of the supplied a.c. voltage, including a capacitor and a resistor. By means of this electronic control, the rotational speed is augmented as soon as the circuit is closed by the first switching mechanism. It is a usual design in this connection, that the pushbutton can be pressed aganst the resistance of at least one return spring and can be completely locked in its pushed-down position.

The construction of the switch is preferably such that in the two chamber arrangement when the actuator is completely moved to an end position one of the switch contacts provides for a short circuit connection so as to cut out the electronic control and prevent its overheating. This is the position in which the pushbutton can be locked. Upon unlocking, or discontinuing the pressure on the pushbutton, the switching operations take place in the reversed order, that is, first the short circuiting of the electronic control is broken up, then the slider is moved back along the resistor whereby the speed is reduced, and finally the current is completely interrupted by the first switching mechanism and the tool or machine is stopped.

Advantageously, this switch is equipped with conventional screwless connecting terminals.

Accordingly, it is an object of the invention to provide an electric switch which comprises a switch housing having a contact arm in the housing which is pivotally mounted on bearing means and includes one arm portion having a movable contact which is engageable in one position thereof with a fixed contact in the housing and an opposite arm portion which is engaged by a cam of an actuating member and which normally holds the movable contact out of engagement with the fixed contact but which upon movement of the actuator will move to permit the first arm portion to engage its contact with the fixed contact in the housing and wherein a loading spring advantageously loads the second arm so that it moves in a direction of contact engagement.

A further object of the invention to provide a switch which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
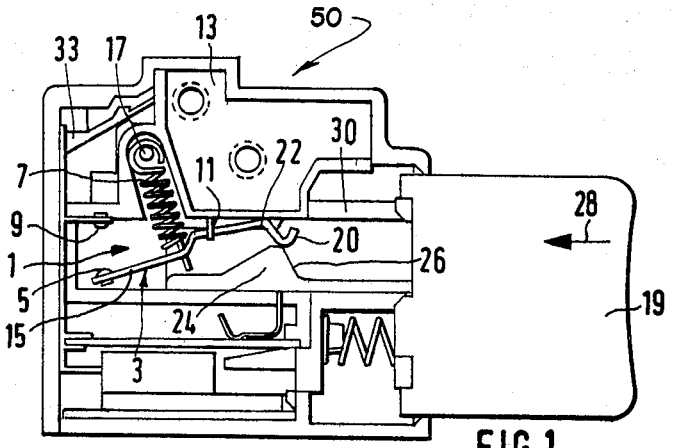
FIG. 1 is a side elevational view of a switch constructed in accordance with the invention showing its cover removed.

Referring to the drawings in particular the invention embodied therein comprises an electric switch which includes a switch housing generally designated 50 having conductive bearing means 11 therein for pivotally supporting a contact arm generally designated 3 which has a first arm portion with a movable contact 5 which is loaded by a loading spring 7 so as to urge the first lever arm portion 15 of the contact arm 3 into engagement with a fixed contact 9 in the housing. An opposite arm portion or second lever arm 22 has a hooked shaped free end 20 which engages on a cam surface 24 of a cam slider portion of an actuating member 19. In the position shown in FIG. 1 the contact arm is held in an unactuated position by the top or tip of the cam 24.

The inventive switch includes a first switching mechanism 1 accommodated in a first chamber, and a second switching mechanism 2 accommodated in a second chamber. Each of the switching mechanisms substantially comprises a contact arm 3, 4 carrying a movable contact 5, 6, a loading spring 7, 8 and an opposite contact 9, 10 designed as a fixed contact. Contact arm 3, 4 is a two-armed lever supported in a bearing 11, 12 which is electrically conducting and connected to a terminal 13, 14. Each contact arm has first and second lever arms (15, 16 and 22, 23) of which a first lever arm 15, 16, preferably set off and carrying the movable contact 5, 6 is connected to the end of a loading spring 7, 8 whose other end is attached to a bolt 17, 18 fixed to the casing. Advantageously, the spring 7, 8 is a helical tension spring having two suspension ends.

Figure 2:
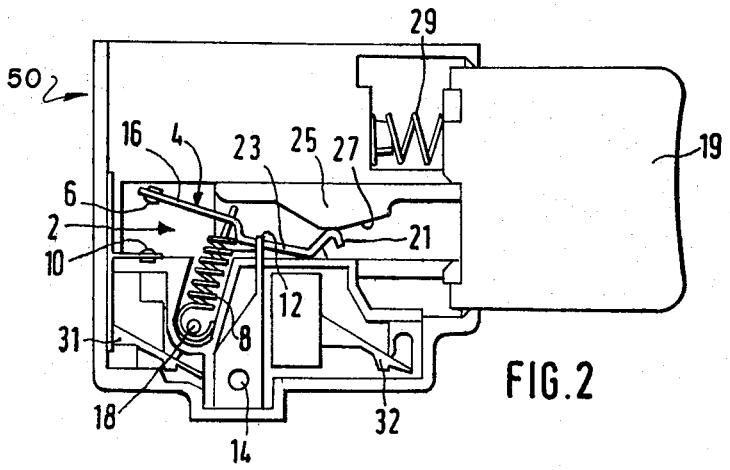
FIG. 2 is a view similar to FIG. 1 of the opposite side of the switch after it has been rotated 180° about a horizontal axis, also with the cover removed or the covering wall omitted.
Figure 3:
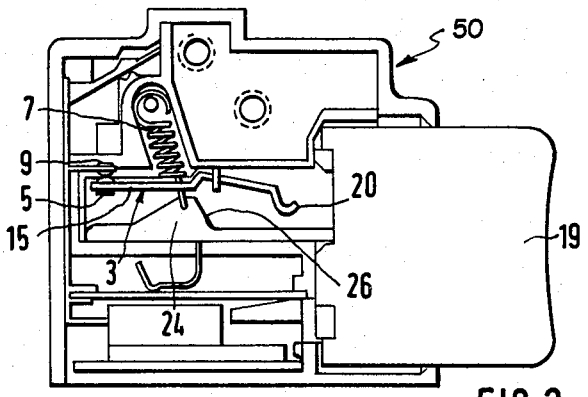
FIG. 3 is a view similar to FIG. 1 showing the switched position of the switch shown in FIG. 1.
Figure 4:
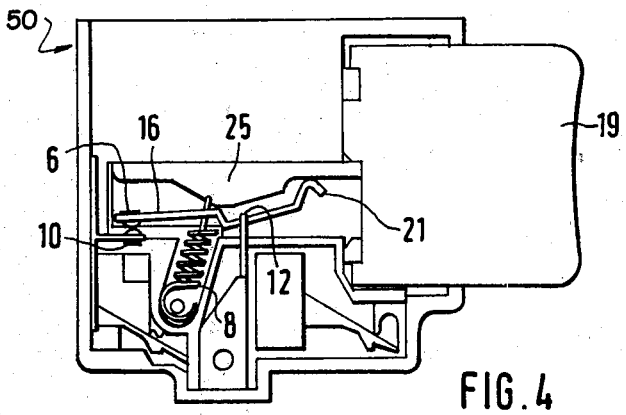
FIG. 4 is a view similar to FIG. 2 showing the switched position of the switch element shown in FIG. 2.

In the initial position shown in FIGS. 1 and 2 of an actuating member 19 defined as a pushbutton, loading spring 7, 8 is fully tensioned. The spring 7, 8 exerts a torque by which contact arm 3, 4 is urged into the closing position. The contact arm, however, cannot perform this rotary motion, because of a free end 20, 21 of the second lever arm 22, 23, which preferably is shaped as a hook, which prevents the rotation by engaging the cam 24, 25.

The two cams 24, 25 are carried on, and preferably integral with, a slider-like inner end of actuating member 19, which is guided in the casing of the switch. Before the switch is actuated the two ends 20, 21 of contact arms 3, 4 bear against the respective cams approximately at their tips. However, the two cams 24, 25 are shaped differently and that is why the two switching mechanisms have unequal switching characteristics. For example, the slope of cam side portion 26 of cam 24 is substantially steeper than that of cam side portion 27 of cam 25.

If now actuating member 19 is displaced in the direction of arrow 28, against the resistance of a return spring 29, movable contact 5 moves into its closing position substantially faster and upon a shorter displacement of actuating member 19, than movable contact 6, which is due to the steeper cam side portion 26 of cam 24 relative to side portion 27. In consequence, first switching mechanism 1 closes earlier than switching mechanism 2. Moreover, second switching mechanism 2 remains open when the actuating member is not sufficiently deeply pushed into the interior of the switch. Conversely, of course, upon releasing the actuating member, the contacts of the second switching mechanism 2 open earlier than those of the first switching mechanism 1.

The switch comprises in addition a third chamber (not shown) accommodating an electronic control including a longitudinally extending resistor which forms part of a known potentiometer. A slider secured to actuating member 19, or to the inner portion 30 thereof, is displaceable along the resistor surface to form the other part of the potentiometer. Such a switch is quite particularly suited for being mounted in a hand operated electric tool, primarily a hand drill. By means of the first switching mechanism, the circuit for the drive motor of the tool is closed. The phase of the a.c. voltage is controlled through the resistor, and the speed is thus augmented by increasing the depth to which actuating member 19 is pushed in the direction of arrow 28 inwardly. With the actuating member completely pushed in, the contacts of second switching mechanism 2 are also closed, whereby the electronic control is short-circuited and protected against overheating, or too strong heating. As actuating member 19 is released, the switching steps are performed in the reverse order.

The switch is equipped with screwless connecting terminals 31, 32, 33 of known construction.

The switch is completely assembled, with the cover cap closed, for example, for being used in hand-operated electric tools. The electronic control and the two switching systems are then opened for checking and adjustment. Especially the electronic control, which is disposed on a ceramic substrate, is adjusted by means of laser equipment. For this purpose, the resistor layer of the potentiometer is burned off more or less by the laser beam and to an extent depending on the required switching point.

While specific embodiments of the invention have been shown and described in detail to illustrate the application of the principles of the invention, it will be understood that the invention may be embodied otherwise without departing from such principles.

What is claimed is:

1. An electric switch comprising a switch housing having a first chamber, a first contact arm in said housing chamber, bearing means pivotally supporting said first contact arm in said housing, said first contact arm having a first lever arm portion with a first movable contact thereon and an opposite second lever arm portion, a first fixed contact in said housing opposite to said first movable contact in a position to be engaged by said first movable contact when said first contact arm is pivoted, a loading spring mounted in said housing and connected to said first lever arm portion biasing said first lever arm portion in a direction to move said first movable contact into engagement with said first fixed contact, an actuator mounted in said housing for movement and having a first cam portion engageable with said second lever arm portion which in the first position of said actuator holds said first contact arm in a first operating position with said first movable contact spaced away from said first fixed contact, said actuator being movable so that said first cam portion permits rotation of said first contact arm under biasing of said spring to hold said first movable contact in electrical contacting engagement with said first fixed contact, said housing having a second chamber, a second contact arm pivotally mounted in said second chamber and having a first lever arm portion with a second movable contact thereon, said housing having a second fixed contact in said second chamber, said second contact arm having an opposite second lever arm portion, said actuator including a second cam portion engageable with said second lever arm portion of said second contact arm and holding said second lever arm portion of said second contact arm so that said second movable contact is out of engagement with said second fixed contact, a second loading spring connected to said first lever arm portion of said second contact arm, said second cam portion of said actuator permitting faster movement of said second contact arm than said first contact arm so that said second contact arm is moved to engage said second fixed contact with said second movable contact faster than said first movable contact engages said first fixed contact.

2. An electric switch according to claim 1 wherein each loading spring comprises a tension spring having one end connected to said housing and an opposite end connected to its respective first lever arm portion.

3. An electric switch according to claim 1 wherein said bearing support means comprises an electrically conducting member having a terminal portion.

4. An electric switch according to claim 1 wherein said first and second chambers are disposed side by side in said housing, said actuator has said first and second cam portions which are provided at mutually spaced locations.

5. An electric switch according to claim 1 wherein said second cam portion of said actuator has a bearing surface engageable with said second lever arm portion of said second contact arm with an edge which is steeper than the first cam portion engageable with said first contact arm.

6. An electric switch according to claim 1 wherein said actuator comprises a member adapted to receive an electronic control resistor thereon which is displaceable to vary resistance in an electrical control circuit.

7. An electric switch according to claim 1 wherein said actuator is adapted to have a resistance for varying a control circuit.

8. An electric switch according to claim 7 wherein one of said second contact arms is adapted to be engaged to short circuit the control circuit.

* * * * *